US008774610B2

(12) United States Patent
Colombo et al.

(10) Patent No.: US 8,774,610 B2
(45) Date of Patent: Jul. 8, 2014

(54) STEAM GENERATOR

(75) Inventors: Roberto Colombo, Conegliano (IT); Maurizio Biasi, Fontanelle (IT); Angelo Irrera, San Vendemiano (IT)

(73) Assignee: I.R.C.A. S.p.A. Industria Resistenze Corazzate e Affini, San Vendemiano (IT)

( * ) Notice: Subject to any disclaimer, the term of this patent is extended or adjusted under 35 U.S.C. 154(b) by 235 days.

(21) Appl. No.: 13/264,214

(22) PCT Filed: Apr. 14, 2010

(86) PCT No.: PCT/IB2010/051611

§ 371 (c)(1), (2), (4) Date: Oct. 13, 2011

(87) PCT Pub. No.: WO2010/119405

PCT Pub. Date: Oct. 21, 2010

(65) Prior Publication Data

US 2012/0039585 A1 Feb. 16, 2012

(30) Foreign Application Priority Data

Apr. 15, 2009 (IT) ..... RM2009A0173

(51) Int. Cl.

| | |
|---|---|
| ***F22B 1/28*** | (2006.01) |
| ***F22B 37/40*** | (2006.01) |
| ***D06F 39/04*** | (2006.01) |
| ***D06F 39/08*** | (2006.01) |

(52) U.S. Cl.
USPC ..... 392/402; 392/396; 239/136

(58) Field of Classification Search
None
See application file for complete search history.

(56) References Cited

U.S. PATENT DOCUMENTS

| | | | | | |
|---|---|---|---|---|---|
| 2,041,815 | A * | 5/1936 | Brown | ..... | 392/479 |
| 2,888,006 | A * | 5/1959 | Martin | ..... | 126/113 |
| 3,683,153 | A * | 8/1972 | Heyer | ..... | 392/403 |
| 3,685,259 | A * | 8/1972 | Rodgers | ..... | 261/142 |
| 4,753,758 | A * | 6/1988 | Miller | ..... | 261/139 |
| 4,990,745 | A * | 2/1991 | Bayles et al. | ..... | 392/386 |
| 5,140,667 | A * | 8/1992 | Youngeberg | ..... | 392/402 |
| 2004/0247302 | A1 * | 12/2004 | Toya et al. | ..... | 392/397 |
| 2011/0147376 | A1 * | 6/2011 | Ueda et al. | ..... | 219/682 |

FOREIGN PATENT DOCUMENTS

| | | | | |
|---|---|---|---|---|
| EP | 1 464 750 | A1 | 10/2004 | |
| EP | 1 845 184 | A1 | 10/2007 | |
| JP | 03267604 | A * | 11/1991 | ..... F22B 5/00 |
| WO | WO2006/126778 | | 11/2006 | |
| WO | WO2007/026990 | | 3/2007 | |

* cited by examiner

*Primary Examiner* — Joseph M Pelham
(74) *Attorney, Agent, or Firm* — Sampson & Associates, P.C.

(57) ABSTRACT

Steam generator (1) is provided with an electric heating element (2) for heating water to be evaporated, consisting of an electric heating resistor (21) inserted in a profiled base (8) of a metal supporting element (7), fixed in a hole obtained in one of the vertical walls (15) of the container (4) for heating water.

14 Claims, 3 Drawing Sheets

STEAM GENERATOR

FIELD OF THE INVENTION

The present invention relates to a steam generator provided with an electric heating element for heating water to be evaporated.

STATE OF THE ART

Steam generators contain electric resistors which are arranged in the lower side of the water container also to permit water to be heated for those work cycles in which there is a little amount of water. The containers are thus equipped with a water collection zone in the lower side where the electric resistor is in any event completely submerged in the water, even in the presence of a little amount of water. This is provided to prevent superheating if the resistor should heat without being covered by water.

Steam generators with electric resistors of this type have some drawbacks. Limescale is easily deposited about the heating element in use and this reduces the heat exchange while increasing the risk of corrosion. Moreover there is a need for the resistor to be fixed to a metal support to ensure its mechanical stability, with the risk of creating corrosion trigger points. There is a need to prepare a specific space in the container for this type of electric resistors, sufficient to ensure that the resistor is always covered by water during the operating cycle to prevent superheating. There is also a need for these electric resistors to be well inserted in the container and fixed thereto with an adequate tightening torque to ensure there are no outward water leaks from the container.

A non-negligible drawback of steam generators of the state of the art is that the volume of water introduced in the container of the generator and to be heated by the electric resistor is quite significant, and thus the steam generation times are rather long. The solution to provide an increased number of resistors applied to the steam generator would lead to increased production costs and in any event is not convenient.

Therefore the need is felt to provide an innovative steam generator which allows to overcome the aforesaid drawbacks.

SUMMARY OF THE INVENTION

It is the primary object of the present invention to provide a steam generator which allows to reduce the steam generation times, the volume of water to be heated and the electric power used being the same.

It is another object of the invention to provide a steam generator constructed so as to minimize the drag of water drops by the steam flow exiting from the generator. A further object of the invention particularly relates to the use of an electric heating element of compact size which does not require large spaces or housings and to be placed in a position of the steam generator where it remains in contact with the water during operation.

The present invention thus intends to achieve the aforediscussed objects by providing a steam generator which, in accordance with claim 1, comprises a container for containing water to be heated, provided with at least one inlet pipe for said water and at least one steam outlet pipe; an electric heating element vertically fixed in an opening obtained in a first vertical wall of the container; wherein said container is provided with a partition wall defining a first chamber, with walls comprising said first wall, and a second chamber communicating with the first chamber at least close to the bottom of the container.

The container of the steam generator of the invention is advantageously divided into two chambers, said evaporation chamber and main chamber, by means of a partition wall which allows a significant reduction of the volume of water to be heated before starting steam generation, thus minimizing the steam generation time.

The communication in the lower side of the container allows the limescale (which is released from the heating surface and falls over the bottom of the container) to accumulate over the whole bottom in both chambers, and moreover keeps an equal level of water in the two chambers.

Moreover, a communication between the two chambers in the upper side of the container allows to balance the pressures in the two chambers and allows the steam generated to flow from the evaporation chamber to the main chamber, thus minimizing the drag of water drops by the steam flow exiting from the generator. Also, there are several advantages as compared to the state of the art, due to the more compact and almost flat or in any event very flattened embodiment of the heating element, combined with the feature of being flat-mounted against a wall orthogonal to the horizontal plane or bottom of the container, containing the water in the lower zone of the household electrical appliance.

The limescale is less inclined to attach to the heating element and moreover tends to be removed on its own due to the thermal dilatation of the surface of the heating element in contact with the water and to the force of gravity itself. Moreover the position chosen for the heating element causes said residues to be dragged towards the lower side of the container, with the advantage of minimizing the danger of superheating or corrosion of the resistor.

A further advantage is that the need to provide a metal support for fixing the heating element to the container is suppressed, with a consequential savings in production costs and a reduction of the corrosion danger. Since the heating element is appropriately attached to the wall of the container, e.g. by means of screws or quick-tightening devices, there is no need to apply a tightening torque to fix the heating element to the wall, which operation is always potentially critical, in particular when the wall to which the heating element is fixed is made of plastic.

Due to the arrangement of the heating element, the NTC (negative temperature coefficient) temperature sensor may be directly arranged on the housing of the heating element to detect the water temperature.

The dependent claims describe preferred embodiments of the invention.

BRIEF DESCRIPTION OF THE DRAWINGS

Further features and advantages of the invention will be more apparent in light of the detailed description of preferred, but not exclusive, embodiments of a steam generator, disclosed by way of a non-limiting example, with the aid of enclosed drawings in which.

DETAILED DESCRIPTION OF PREFERRED EMBODIMENTS OF THE INVENTION

Figure 2:
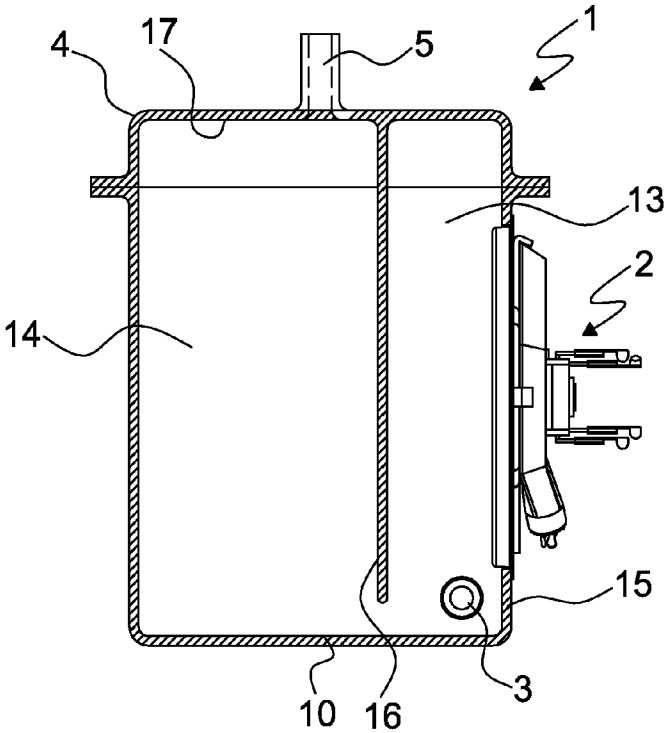
FIG. 2 shows a cross section of the steam generator in FIG. 1.
Figure 1:
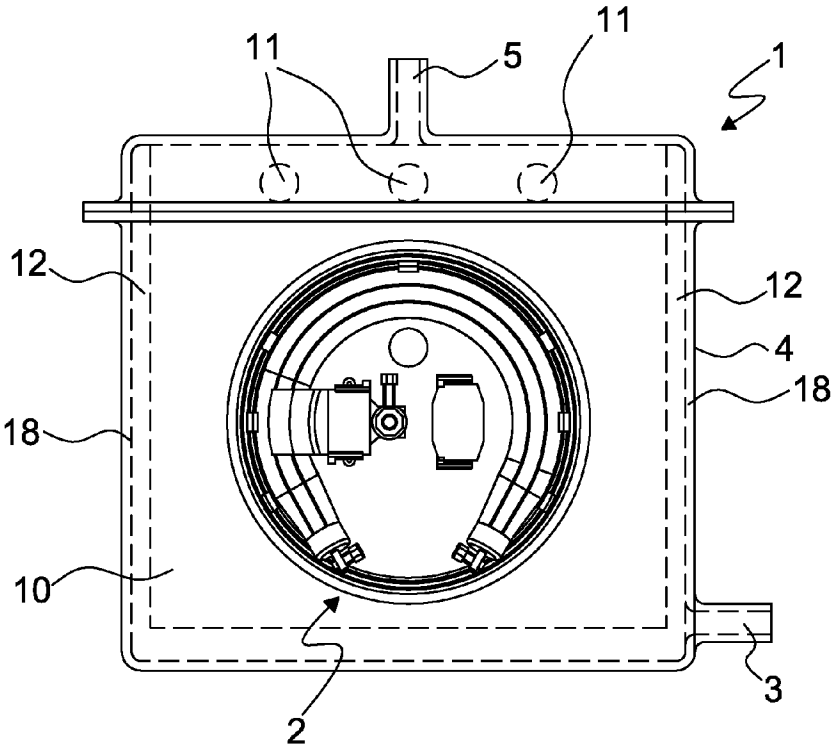
FIG. 1 shows a side view of a first embodiment of the steam generator according to the invention.

With particular reference to FIGS. 1 and 2, a first embodiment of a steam generator object of the present invention is described.

The steam generator, globally indicated by the reference number 1, comprises a container 4, substantially of a rectangular or cube-paralielepiped shape, for containing water to be heated and to be evaporated, said container being provided with a water inlet pipe 3 and an outlet pipe 5 for the steam generated.

The steam generator 1 is provided with an electric heating element 2 which is advantageously fixed so as to be vertical to an opening 6 produced in a vertical wall 15 of container 4. In this case, all limescale which forms during the work cycle is deposited on the lower side of container 4 thus making the steam generator 1 easier to be cleaned. The outer shape of the heating element 2 is circular but may be made in different shapes. The heating element 2 in FIGS. 1 and 2 is substantially flat with a steel plate and an aluminium resistor brazed on said plate. Container 4 is advantageously provided with a partition wall 10 so as to define a first chamber or evaporation chamber 13, comprising the vertical wall 15 on which the electric heating element 2 is fixed, and a second chamber or main chamber 14, communicating with the first chamber 13 at least close to the bottom 16 of container 4. This communication at the lower side of container 4 allows the limescale, which is released from the heating surface and falls over the bottom 16, to accumulate over the whole bottom 16 in both chambers. The limescale dispersion from the evaporation chamber to the main chamber is facilitated by the water entering through pipe 3, in particular if pipe 3 is provided at the lower side of the evaporation chamber 13. Moreover, this communication in the lower part of the container keeps an equal level of water in the two chambers due to the principle of communicating vessels.

The partition wall 10 is preferably integral with the upper wall 17 of container 4. It may be made as an integral part of container 4 or as a separate element integrally fixed to the upper wall 17 and/or to the side walls 18.

Providing this partition wall 10 in container 4 advantageously permits the reduction of the volume of water to be heated before starting steam generation, thus minimizing the steam generation time.

The second chamber 14 preferably but not necessarily has a volume larger or equal to the first chamber 13 of container 4. In the case in FIG. 2, the first chamber 13 has a volume equal to about one third of the total volume of container 4, and accordingly the second chamber 14 has a volume equal to about the two thirds of said total volume. This results in a significant reduction of the volume of water to be heated before starting steam generation in chamber 13.

The first chamber 13 and the second chamber 14 may also be communicating close to the side edges of the partition wall 10. Indeed, introduction ports 12 may be provided between the wall 10, substantially extended over almost the whole width corresponding to the width of the vertical wall (FIG. 1), and the side walls 18 of the container 4.

A further advantage is that the partition wall 10 is provided with openings 11, e.g. pinholes, close to the upper wall 17 of container 4 for the steam to pass from the first chamber 13 to the second chamber 14.

In an alternative variant (not shown), the partition wall 10 is only integral with at least one side wall 18, preferably two side walls 18, of container 4 and is conveniently spaced from the upper wall 17 therefore leaving an opening for the steam to pass which extends over the whole width of the wall 10.

The connection between the two chambers 13, 14 in the upper part of the container allows the steam to flow from the evaporation chamber 13 to the main chamber 14. Thereby, the flow of steam also loses the drops of water dragged before leaving the pipe 5. Moreover, said connection in the upper part of the container allows the pressures in the two chambers 13, 14 to be balanced.

The outlet pipe 5 for the steam generated is preferably but not necessarily placed in the second chamber 14 or main chamber, close to the upper wall 17. In an alternative variant, the steam outlet pipe is placed in the first chamber 13 with the advantage of heating the cold side of the container to a lesser extent, thus maximizing the steam generation in a short period.

A first preferred solution includes the pipe 5 on the upper wall 17 of the container; a second solution includes said pipe 5 on the upper part of a side wall of the container.

In a preferred solution, the water inlet pipe 3 is placed in the first chamber 13 or evaporation chamber, preferably close to the bottom 15 of the container, with the advantage of facilitating the limescale dispersion over the bottom of the container. In an alternative variant, the water inlet pipe is placed in the second chamber 14, preferably close to the bottom 16 of the container, with the advantage of introducing the cold water in the coldest side of container 4, and therefore of delaying the restarting of steam generation.

Figure 3:
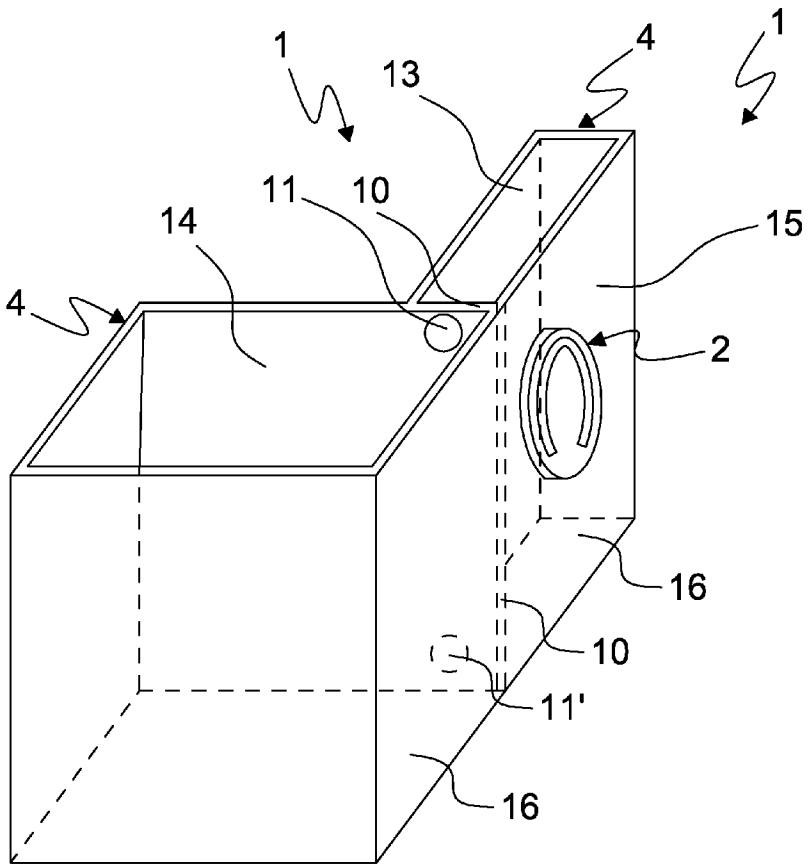
FIG. 3 shows a diagrammatic axonometric view of a second embodiment of the steam generator according to the invention.

FIG. 3 diagrammatically depicts a second embodiment of the steam generator of the invention, where the same elements described in the first embodiment are indicated with the same reference numbers.

For simplicity of representation, the layout in FIG. 3 does not show the upper wall of container 4, the water inlet pipe in the evaporation chamber 13 and the steam outlet pipe in the main chamber 14.

In this variant the first chamber 13 has a smaller volume than the second chamber 14, and a side wall of the first chamber 13 forms a side of a side wall of the second chamber 14. This side wall of the first chamber 13 thus defines the partition wall 10 between the two chambers. At least one opening 11, e.g. at least one pinhole, is provided in the upper side of said wall 10 for the steam generated by the chamber 13 to pass to chamber 14, and at least one opening 11', e.g. at least one pinhole, is provided in the lower part of said wall 10 for the water to pass between the two chambers. Wall 10 is advantageously raised with respect to the common bottom 16 of the two chambers so as to facilitate the limescale dispersion over the whole bottom of container 4.

The operation of the steam generator is the same in both of the afore-described embodiments. The volume of water to be heated to reach the boiling point is just that contained in the evaporation chamber 13.

Figure 4:
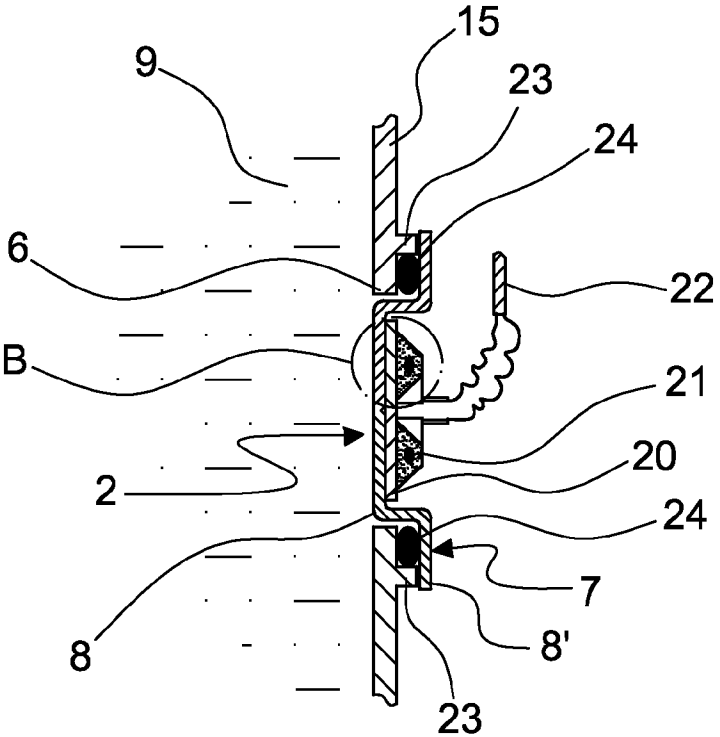
FIG. 4 shows a diagrammatic cross-section view of a component of the steam generator of the invention.

With particular reference to FIG. 4, the vertical wall 15 of the container has an opening 6 in which the supporting element 7 of a heating element 2 is inserted, consisting of a metal sheet, e.g. stainless steel or another equivalent metal, conveniently shaped. The base 8 of the supporting element 7 is advantageously but not necessarily circle-shaped in plan, the dimensions of which correspond to those of hole 6 in which the supporting element 7 is inserted and fixed by fixing means of known type, not shown in the figure. For example, these may be screws, clamps or other conventional fixing means or quick-release means. Considered in a diametral section, the base is flat-shaped, but may also be made having a spherical cap shape with a very large bending radius. Moreover the bending may be made in either a concave shape or a convex shape.

With reference to the arrangement shown in FIG. 4, the water to be evaporated 9 is contained in the left part of the vertical wall of container 4, and the outer access side for mounting or maintaining or repairing the heating element 2 is provided on the right side.

The supporting element 7 incorporates a heat dissipator 20 on the outer side thereof, advantageously made of aluminium or thermally conductive equivalent material, for a better heat distribution. The dissipator 20 is conveniently fixed to the surface of the supporting element 7, e.g. by brazing.

The heating element 2 comprises the electric resistor 21 fixed in turn to the outer side of dissipator 20. The electric resistor 21 (shown in FIG. 4 only by way of example) may be in various shapes. Its shape and overall dimensions are such to allow it to be contained within the heating element 2. In this variant, the resistor is bent in a loop shape (FIG. 1), but it may be serpentine-shaped or may have another shape which is just as compact. Magnesium oxide (MgO) along with silicone are used to protect the resistor and other electric components of the heating element (which form an electric insulator) from humidity while allowing the heat generated from the resistor to pass.

If required, the heating element 2 may comprise other components on the outer side thereof, required for the proper operation of the heating element, such as the thermostat and the temperature fuse to permit a controlled release in the case of overload.

When an NTC temperature sensor is provided, it may be directly placed on the housing of the heating element 2, in a much simpler and improved position as compared to the state of art which generally arranges it on the resistor itself inside the container of the household electrical appliance. Such an arrangement allows savings on the production costs of the heating element 2.

A structural element is provided on the wall of container 4 for an enhanced hydraulic seal, e.g. an annular ridge 23, having a shape corresponding to the periphery of the supporting element 7, to optimize the contact between the heating element 2 and the wall of container 4. A separate sealing element is also advantageously provided, e.g. an O-ring 24, between the supporting element 7 and the wall 4. Other equivalent sealing elements may be used in place of or in addition to the O-ring 24. An annular flange 8' is provided in the peripheral zone of the base 8 of the supporting element 7 to allow enhanced positioning and optimal fixing of the heating element 2.

The heating element 2 is connected by known means to the power electric line 22 when it is mounted to the vertical wall of the container 4 of the steam generator. Moreover, due to the heating element 2, this is a solution having particularly compact volume with some advantages of use as compared to the solutions of the state of art when it is mounted to steam generators. A particular advantage consists in that air bubbles are formed when the water starts boiling in the zone close to the heating element 2 if the heating element 2 is only partially submerged in or lapped by water, due to the reason why the evaporation chamber 13 is not completely full of water. The bubbles produce a turbulent movement of water which practically makes the water level rise in that zone thus allowing the heating element 2 to be kept submerged and achieving a better efficiency of the heat exchange during operation.

Figure 5:
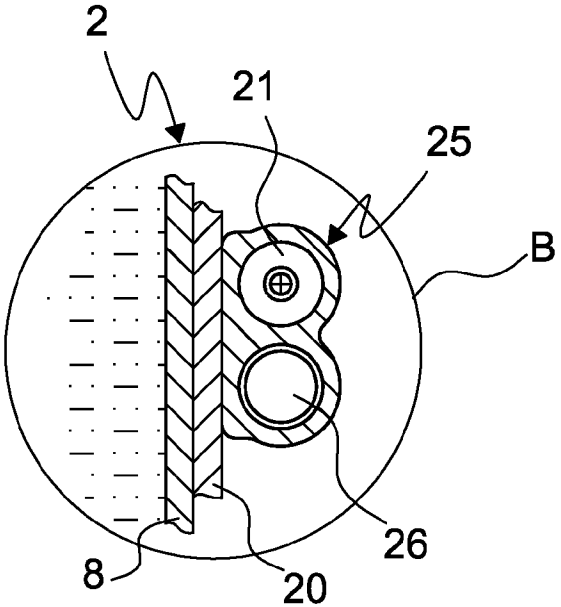
FIG. 5 shows an enlarged cross-section view of detail B in FIG. 4 in a variant in accordance with the invention.

With particular reference to FIG. 5, a peculiarity of a variant of the heating element 2 is shown, where the same elements described in the preceding embodiments are indicated by the same reference numbers. The heating resistor 21 is inserted into an extruded tubular element 25, e.g. made of aluminium, which also has a pipe 26 obtained in the same extruded element, for the introduction of a fluid. Therefore, pipe 26 is by the side of the electric resistor 21 over its whole length, or over a part thereof. This solution permits an optimal thermal conductivity to be created between the electric resistor 21 and the pipe 26, and a part of the heat generated from the electric resistor 21 to be also used for heating the fluid passing through the pipe 26.

In an advantageous solution of a steam generator, the pipe 26 of the heating element 2 is directly communicating (by means of pipes not shown in the figures) with the steam outlet pipe 5, and the steam generated in the steam generator 1 is conveyed in said pipe 26 so as to generate superheated steam.

The heat to generate the steam may also be supplied by means of an electric heating element, arranged in a vertical position along a vertical wall of the generator container, of the type:

- a resistor fixed to a die-cast plate by re-pressing in a cavity,
- a resistor incorporated into the mass of a die-cast plate at the time of casting;
- a resistive silk-screen insert ("thick film" resistor) printed onto a steel plate.

Advantageously, by providing the electric heating element in a vertical position along a vertical wall of the generator container, it has been also noted that the limescale which detaches from the heating surface and falls over the bottom of the container is in the shape of very thin scales, if compared to the scales which are detached from a tubular resistor of those commonly used in laundry machines and in many steam generators. This advantage was particularly noted by using a resistor having a "brazed plate", like that shown in FIG. 4, for example.

The invention claimed is:

1. A steam generator comprising:

a container for containing water to be heated, provided with at least one inlet pipe of said water and at least one steam outlet pipe and a bottom in contact with the water contained in the container;

an electric heating element fixed in an opening produced in a first vertical wall of the container, the first wall being orthogonal to the bottom;

wherein said container is provided with a partition wall defining a first chamber, with walls comprising said first wall, and a second chamber in liquid communication with the first chamber at least in proximity of the bottom of the container, and wherein that said heater is flat-mounted against said first wall.

2. A steam generator according to claim 1, wherein said partition wall is integral with an upper wall of the container.

3. A steam generator according to claim 2, wherein said second chamber communicates with the first chamber in proximity of a side edge of said partition wall.

4. A steam generator according to claim 1, wherein said partition wall is integral with at least one side wall of the container and is spaced from an upper wall of the container.

5. A steam generator according to claim 2, wherein in proximity of the upper wall, the partition wall is provided with at least one opening for the steam to pass from the first chamber to the second chamber.

6. A steam generator according to claim 1, wherein the second chamber has a volume larger than or equal to that of the first chamber.

7. A steam generator according to claim 2, wherein the steam outlet pipe is placed either in the second chamber or in the first chamber in proximity of the upper wall of the container.

8. A steam generator according to claim 7, wherein the water inlet pipe is placed either in the first chamber or in the second chamber in proximity of the bottom of the container.

9. A steam generator according to claim 1, wherein the heating element is placed on said first vertical wall so as to remain at least partially submerged in use into the water.

10. A steam generator according to claim 1, wherein the electric heating element comprises:

a metal supporting element having a base with a first side, named inner side, placed in contact with the interior of the container, and a second side, named outer side, on the side of the base opposite to the inner side and positioned on the outer side of said container;

an electric heating resistor, fixed to the outer side of the supporting element;

sealing means for preventing the fluids from passing between the outer side and the inner side;

a metal heat dissipation disc interposed between the electric heating resistor and the supporting element.

11. A steam generator according to claim 10, wherein a base of the supporting element is circle-shaped in plan and either flat or spherical cap-shaped in section.

12. A steam generator according to claim 9, wherein an annular flange is provided in a peripheral zone of the base.

13. A steam generator according to claim 10, wherein a steam passage pipe is provided by the side of the electric heating resistor adapted to produce superheated steam.

14. A steam generator according to claim 1, wherein the electric heating element is either a resistor fixed to a die-cast plate by means of re-pressing into a cavity, or is a resistor incorporated into the mass of a die-cast plate at the time of casting, or is a resistive insert silk-screen printed onto a steel plate.

* * * * *

UNITED STATES PATENT AND TRADEMARK OFFICE

CERTIFICATE OF CORRECTION

PATENT NO. : 8,774,610 B2
APPLICATION NO. : 13/264214
DATED : July 8, 2014
INVENTOR(S) : Colombo et al.

It is certified that error appears in the above-identified patent and that said Letters Patent is hereby corrected as shown below:

In the Claims:

Column 6, Line 45, before the word “wall” delete the word “vertical”;

Line 51, after the word “wherein” delete the word “that”.

Signed and Sealed this
Seventh Day of October, 2014

Michelle K. Lee

Michelle K. Lee
*Deputy Director of the United States Patent and Trademark Office*